US005283096A

United States Patent [19]

Greenberg et al.

[11] Patent Number: 5,283,096

[45] Date of Patent: Feb. 1, 1994

[54] RESILIENT STRIP FOR PROTECTIVE STRIP ASSEMBLY

[75] Inventors: David A. Greenberg, Winchester; Joseph W. Manning, Peabody, both of Mass.; Charles M. Wheeler, Salem, N.H.; Sanford J. Kessler, Youngstown, Ohio

[73] Assignee: Boston Metal Products Corp., Medford, Mass.

[21] Appl. No.: 873,300

[22] Filed: Apr. 23, 1992

[51] Int. Cl.[5] ..... E04F 19/02; B60J 11/00

[52] U.S. Cl. ..... 428/67; 428/99; 428/100; 428/122; 428/217; 428/31; 52/716.6; 52/718.06; 52/717.03; 24/297

[58] Field of Search ..... 428/67, 99, 100, 217, 428/31, 122; 52/717.1, 718.1; 24/293, 294, 297

[56] References Cited

U.S. PATENT DOCUMENTS

| | | | |
|---|---|---|---|
| 4,083,592 | 4/1978 | Rubin et al. | 293/71 R |
| 4,246,303 | 1/1981 | Townsend | 428/217 |
| 4,808,451 | 2/1989 | McCue et al. | 428/31 |
| 4,894,972 | 1/1990 | Endoh et al. | 52/716 |
| 4,911,971 | 3/1990 | McCue et al. | 52/717.1 |
| 4,948,637 | 8/1990 | Kessler | 428/31 |
| 5,013,596 | 5/1991 | Kessler | 428/100 |
| 5,033,244 | 7/1991 | Ullman | 52/288 |

FOREIGN PATENT DOCUMENTS

| | | |
|---|---|---|
| 331393 | 8/1958 | Switzerland . |
| 2200870 | 8/1988 | United Kingdom . |

*Primary Examiner*—Alexander S. Thomas
*Attorney, Agent, or Firm*—Hale and Dorr

[57] ABSTRACT

The invention features a flexible protective strip having one or more longtitudinally extending inserts which provide the protective strip with greater impact resistance, greater strength and an improved locking action in the mounting member. The resilient strip preferably includes a pair of oppositely disposed, inwardly extending latch members which include inserts to provide the improved locking action. The mounting member preferably includes a web portion having a pair of oppositely disposed web-latch extensions extending across a chord of the body, substantially parallel to a tangent to the circumference of the body at its mid-line, and at least one leg member extending from the web portion away from the body.

12 Claims, 2 Drawing Sheets

RESILIENT STRIP FOR PROTECTIVE STRIP ASSEMBLY

BACKGROUND OF THE INVENTION

This invention relates generally to protective bumper strip assemblies for protecting furniture edges, wall and display case surfaces and the like. In particular, this invention is directed to resilient bumper strips which provide improved strength, improved impact resistance, improved resistance to stretching and shrinking, and improved mating with the mounting member.

Protective strip assemblies using resilient strip materials in various types of channels are known in the art, as illustrated in U.S. Pat. Nos. 5,013,596, 4,083,592, and 4,808,451 and the patents cited therein. The protective strip assembly disclosed in each of those patents includes a metal or plastic channel capped by a strip of a resilient material, such as rubber. The channel, which may be roughly rectangular in its outside cross-section, attaches to a surface to be protected. The resilient rubber strip is secured to the channel member and partially surrounds and engages the channel along the channel faces that face generally perpendicular to the surface to be protected.

It is an object of this invention to provide a protective bumper strip assembly having a flexible bumper strip which has greater strength than prior art strips.

It is another object of this invention to provide a flexible protective resilient strip having improved impact resistance.

It is a further object of this invention to provide a protective bumper strip assembly having a bumper strip which resists shrinking and stretching.

It is yet another object of this invention to provide a flexible resilient strip which can be more securely locked to the mounting member of the protective strip assembly

SUMMARY OF THE INVENTION

This invention relates to a protective strip assemblies in which the flexible resilient strip includes one or more longitudinally extending inserts. Preferably, the body of the resilient strip is co-extruded with one or more inserts which are stiffer than the body of the resilient strip. The location and dimensions of the insert(s) will vary depending on the particular application of the protective strip assembly The impact resistance and strength of the resilient strip will increase with an increase in the dimensions and/or the quantity of the inserts.

The co-extruded strip is secured in, and partially surrounds, the mounting member and may conceal it. The resilient strip member may be any shape but it is preferably semi-cylindrical body having a pair of circumferentially-facing edge portions. The resilient strip preferably includes a pair of oppositely disposed, inwardly extending latch members, each extending longitudinally of the strip and located between one of the edge portions and a point away from the mid-line of the semi-cylindrical body. The latch members and/or the circumferentially-facing edge portions may contain inserts. The presence of inserts in the latch members will stiffen the latch member and thereby provide an enhanced locking feature because the latch member will resist displacement if it receives an impact. In addition, the inserts in the latch members will maintain the integrity of the latch members after the extrusion process.

The circumferentially-facing edge portions may also contain inserts. The presence of inserts in the edge portions will cause the edge portions to resist deflection against the mounting channel and thereby inhibit the outward movement of the latch members.

In the mounting member, a pair of oppositely disposed base members, each extend from a leg member, away from each other and each terminate in a base latch portion. Each of the pair of web latch extensions extend toward the semi-cylindrical body adjacent the latch member, between the latch member and the mid-line of the semi-cylindrical body. Each of the pair of base latch portions contact the latch member intermediate its inward extension. The inwardly extending latch members may terminate in a small hook, having its opening on the side of the latch member nearest the base member of the mounting member.

The protective strip assembly of this invention improves over the prior art in that it provides improved impact resistance, resists stretching and shrinking due to changes in temperature and humidity, provides greater strength and provides an improved locking action.

DETAILED DESCRIPTION OF THE PREFERRED EMBODIMENTS OF THE INVENTION

Figure 1:
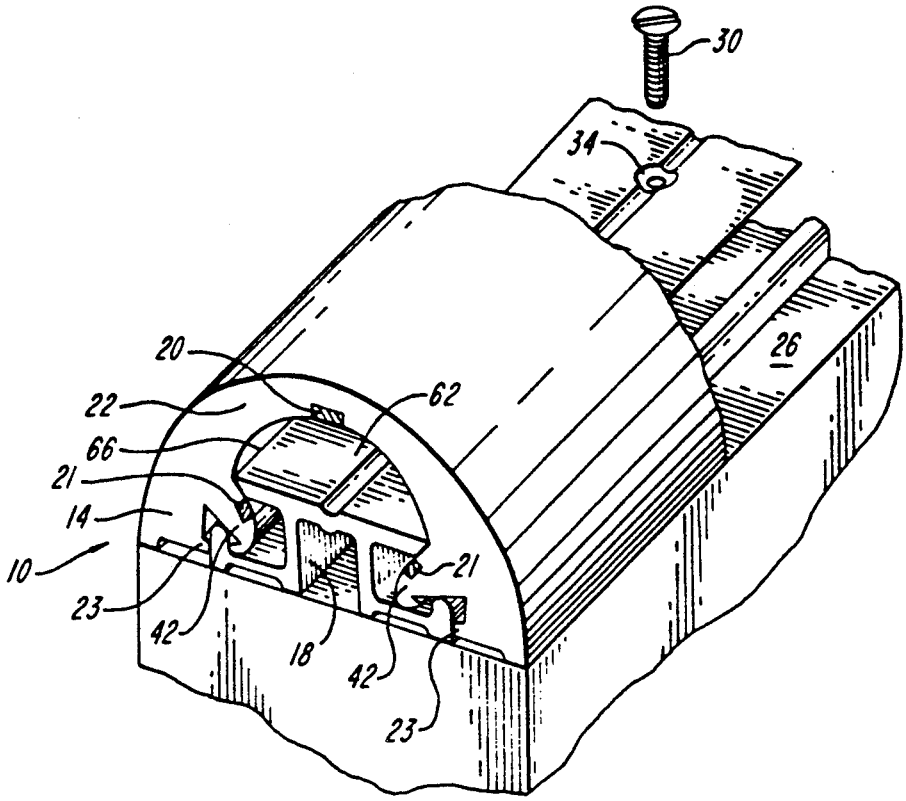
FIG. 1 is a perspective view of a portion of one embodiment of a combined resilient strip and mounting member of the claimed invention with some portions of the resilient strip removed.

Referring to FIG. 1, one embodiment of a resilient strip assembly 10 of this invention is shown in perspective, showing a resilient strip 14 and a mounting member 18 of the claimed invention, with some portions of the resilient strip 14 removed.

The resilient strip 14 includes one or more longitudinally extending inserts 20, 21, 23 which are made of a material which is stiffer or harder than the material which makes up the body 22 of the resilient strip 14. Preferably, the resilient strip is coextruded with one or more inserts; however, it is also possible to mechanically place inserts in the resilient strip once the strip has been fabricated. The location, dimensions and quantity of the inserts will vary depending on the particular application of the protective strip assembly. For example, the impact resistance and strength of the resilient strip will increase with an increase in the thickness and/or quantity of the inserts. The inserts will be fabricated from a material having a greater impact resistance than the material from which the body 22 of the resilient strip is made. Preferably, the body of the resilient strip will be made out of a flexible vinyl material having a hardness of between about 90 to 95 durometers on the Shore D Scale; The inserts are preferably made out of a flexible vinyl or plastic material having a hardness of about 45 durometers on the Shore D Scale. The precise materials used will vary depending on the use of the protective strip assembly. It will be understood that certain applications will require a resilient strip having a greater impact resistance than other applications.

Figure 2:
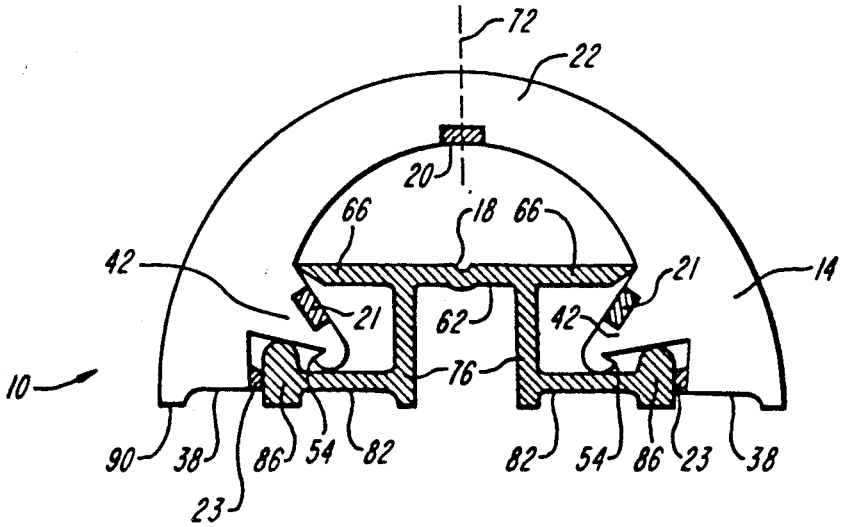
FIG. 2 is a cross-section of one embodiment the resilient strip and mounting member of the invention.

The inserts 20 may be located at any position along the inside or the outside of the resilient strip; however, they are preferably located on the inside surface. Referring to FIGS. 1 and 2, the insert 20 is located on the inside surface of the resilient strip near the midline of the resilient body. At this position, the inserts provide the resilient strip with greater strength and impact resistance. The inserts may also be fabricated into the latch members 42 (see below) to provide the resilient strip with an improved locking mechanism. Inserts 21 are fabricated into the latch members, thereby providing an improved locking action because the inserts 21 provide the latch members 42 with greater rigidity and, therefore, improved resistance to displacement. In addition, inserts 21 provide a means to maintain the integrity of the latch members 42 immediately after the extrusion process. In this way, the latch members will fit in mounting member 18 with greater precision. Inserts 23 are fabricated into edge portion 38 to provide the edge portions with improved impact resistance. If resilient strip 14 receives an impact it will resist deflecting toward latch portion 86 of mounting member 18.

The resilient strip 14 may be any desired shape but is preferably a semi-cylindrical body 22. When the strip is semi-cylindrical it surrounds the mounting member 18 on three of its four sides. The rubber strip may butt up against the surface to be protected, wholly concealing the channel. It may also be designed such that it only partially conceals the channel. The mounting member 18 may be secured to the surface to be protected 26 by means of mounting screws shown representatively at 30 which secure the mounting member through hole 34.

Still referring to FIG. 2, it can be seen that when the mounting member 18 and resilient strip 14 are assembled, the web portion 62 of mounting member 18 extends across a chord of the body 22, substantially parallel to a tangent to the circumference of the semi-cylindrical body portion at its mid-line 72.

The protective strip assembly of this invention is used in department stores and supermarkets to protect walls and food storage cases from being damaged by shopping carriages. It is also used in hospitals or other facilities to protect walls from damage caused by stretchers, carts, and the like.

Figure 3:
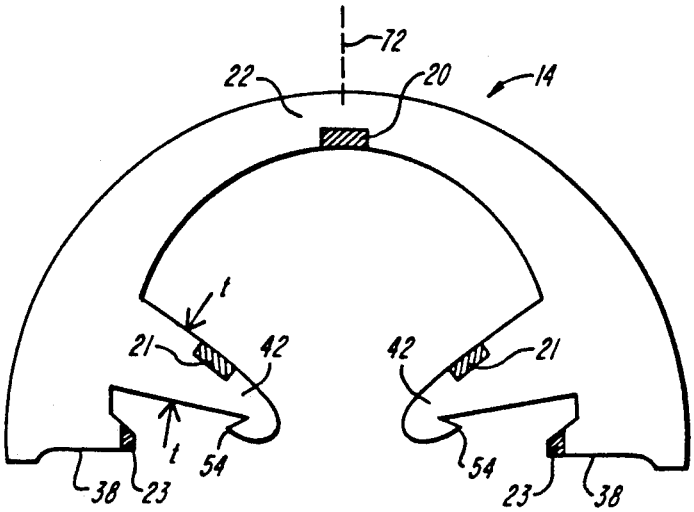
FIG. 3 is a cross-section of one embodiment of the resilient strip of the invention.

Referring now also to FIG. 3, which shows one embodiment of the resilient strip 14 of this invention alone, it can be seen that the semi-cylindrical body 22 is bounded by circumferentially facing edge portions 38. Latch members 42 extend inwardly from the semi-cylindrical body 22 at a location between the edge portions 38 and a point 45 degrees away from the mid-line 72 of the body 22. As shown in FIG. 1, latch members 42 extend longitudinally along the length of the resilient strip 14. Inwardly extending latch members 42 are preferably solid, each terminating in a small hook 54. Hooks 54 facilitate retention of resilient strip 14 by mounting member 18, as explained below. As described above, insert 20 provides greater impact resistance and inserts 21 provide an improved locking action.

As shown in the embodiment set forth in FIG. 2, the web latch extensions 66 of the mounting member 18 extend outwardly to a position closely adjacent but inward of an upward projection of the base latch portions 86 and the base latch portions 86 extend upwardly to a position closely adjacent but below an outward projection of the web latch extensions 66.

The latch extensions 66 of the web portion 62 are sized to extend to the body adjacent the inwardly extending solid latch members 42. It is not necessary that the web-latch extensions 66 actually contact the body 22 or the latch members 42. The base latch portions 86 mate with the body 22 adjacent the other side of the inwardly extending latch members 42. Thus, each inwardly extending latch member 42 is located between a respective web latch extension 66 and base latch portion 86.

Engagement of the strip 14 with the mounting member 18 is facilitated due to the generally wedge shape of latch members 42. As the resilient strip 14 is pressed against the mounting member 18, the leading edges of the inwardly extending latch members 42 wedge between web latch member 66 and base latch member 86. The thickness of the inwardly extending latch members 42 (measured between arrows t in FIG. 3) is less than the shortest distance between web latch extension 66 and base latch portion 86, perpendicular to the path of insertion of inwardly extending latch member 42.

Figure 4:
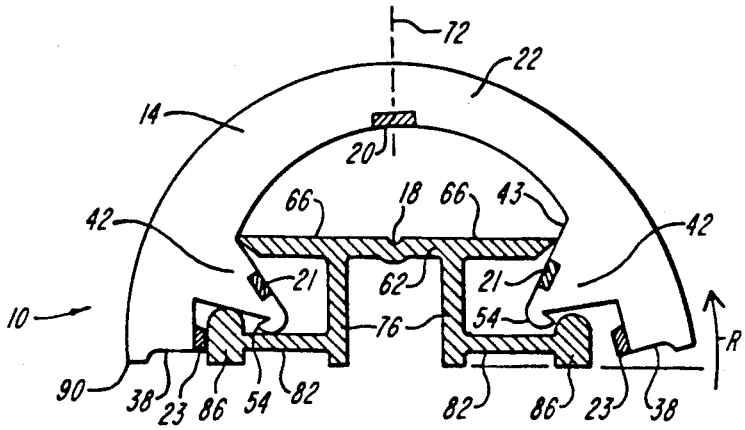
FIG. 4 is a cross-section of one embodiment of the resilient strip and the mounting member of the invention, with the resilient strip shown being forced away along one longitudinal edge.

The manner by which the resilient strip 14 is retained by mounting member 18 will be understood with reference to FIG. 4. In the case of a force or moment in the direction indicated by arrow R tending to remove the resilient strip, the base 43 of inwardly extending latch member 42 contacts the end of web latch extension 66, and tends to pivot about it. At the same time, hook 54 at the end of radial latch member 42 is swung into contact with base latch portion 86, which prevents removal of the latch member 42. Hook 54 is not absolutely necessary, however, it enhances the retention.

The foregoing discussion illustrates the important parameters regarding the size of the inwardly extending latch member 42. They should be long enough so that when a force R is applied and the base 43 of latch member 42 contacts web latch extension 66, the tip of latch member 42 pivots into base latch portion 86 and is retained.

Another embodiment of the mounting member of the invention is illustrated with reference to FIG. 5 and may be used in situations where additional security is required in the engagement of the resilient strip 14 and the mounting member.

Figure 5:
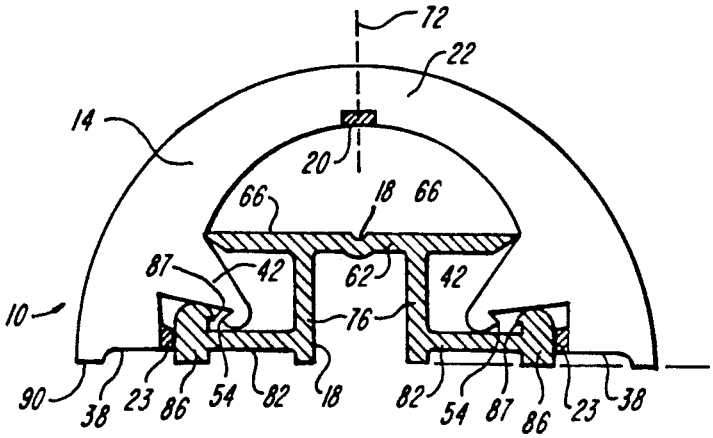
FIG. 5 is a cross-section of one embodiment of the resilient strip and the mounting member.

As shown in FIG. 5, mounting member 18 is provided with hooks 87 at the ends of base latch portions 86. The open portion of mounting member hooks 87 face the open portion of latch member hooks 54. When the resilient strip 14 is forced away from the mounting member 18, the hooks 54 and 87 engage each other and lock the resilient strip 14 to the mounting member 18.

Additional features of the invention will be appreciated by those skilled in the art. The body of the strip portion may be advantageously made from vinyl, such as polyvinyl chloride. Polyvinyl chloride is non-marking and provides a high degree of impact and abrasion resistance. The inserts 20, 21 may be chosen from any of a number of materials which include, but are not limited to, vinyl or plastic materials. The mounting member may be advantageously made from aluminum, rigid plastic or a rigid graphite composite.

The protective strip assembly may be advantageously used around refrigeration cases, along walls and corridors to protect the walls and corridors from impact due to moving carriages, around checkout counters in grocery and department stores, around island displays in department stores and upon the ends of display cases. The strips protect not only the surface upon which they are mounted, but also objects and persons that may contact those surfaces.

The foregoing description should be taken as illustrative and not limiting in any sense. Other embodiments of the invention will occur to those skilled in the art and are within the scope of the following claims.

What is claimed is:

1. An elongated resilient strip adapted to be secured to and partially surround a mounting member, said resilient strip comprising:
   (a) a body having a pair of edge portions at least partially defining the exterior perimeter of said body;
   (b) one or more longitudinally extending inserts surrounded on at least three sides by said body, the material of said inserts having greater impact resistance than the material of said body; and
   (c) a pair of oppositely disposed, inwardly extending latch members, each located between a point away from the mid-line of the body and the closest edge portion.

2. An elongated resilient strip adapted to be secured to and partially surround a mounting member, said resilient strip comprising:
   (a) a body having a pair of edge portions at least partially defining the exterior perimeter of said body;
   (b) one or more longitudinally extending inserts surrounded on at least three sides by said body, the material of said inserts having greater impact resistance than the material of said body; and
   (c) a pair of oppositely disposed, inwardly extending latch members, each located between a point away from the mid-line of the body and the closest edge portion and each terminating in a hook having an opening on the side of the latch member facing away from the midline of the body.

3. A protective strip assembly comprising:
   a mounting member; and
   an elongated strip of resilient material secured to said mounting member, said strip having a body and one or more longtiudinally extending inserts surrounded on at least three sides by said body, the material of said inserts having a greater impact resistance than the material of said body, said strip further comprising a pair of oppositely disposed, inwardly extending latch members, each located between a point away from the mid-line of the body and the closest edge portion.

4. A protective strip assembly comprising, in combination, a mounting member and an elongated strip of resilient material secured in the mounting member;
   (a) The resilient strip comprising:
      (1) a body partially surrounding the mounting member;
      (2) a pair of oppositely disposed, inwardly extending latch members, each located between a point away from the mid-line of the body and the closest edge portion; and
      (3) one or more longitudinally extending inserts surrounded on at least three sides by said body, the material of said inserts having a greater impact resistance than the material of said body;
   (b) The mounting member comprising:
      (1) a web portion having a pair of oppositely disposed web latch extensions extending generally across a chord of the body;
      (2) at least one leg member extending from a second surface of the web portion away from the body;
      (3) a pair of oppositely disposed base members:
         (i) each extending from a leg member, away from each other;
         (ii) each terminating in a base latch portion; wherein each of the pair of web latch extensions mates with the body adjacent the inwardly extending latch member, between the inwardly extending latch member and the mid-line of the body, and each of the pair of base latch portions mates with the body adjacent the inwardly extending latch member, between the inwardly extending latch member and the closest end portion.

5. The protective strip assembly of claim 4, said inwardly extending latch members terminating in a hook.

6. The protective strip assembly of claim 4, said base latch portions terminating in a hook.

7. The protective strip assembly of claim 4 where the mounting member comprises an elongated channel and the web portion, web latch extensions, leg members, base members and base latch extensions extend along the channel in the direction of its elongation.

8. The protective strip assembly of claim 4 where the insert is made of plastic.

9. The protective strip assembly of claim 4, wherein the channel mounting member is aluminum.

10. The protective strip assembly of claim 4, wherein the channel mounting member is a rigid plastic.

11. The protective strip assembly of claim 4, wherein the channel mounting member is a rigid graphite composite.

12. An elongated resilient strip adapted to be secured to and partially surround a mounting member, said resilient strip comprising:
   (a) a body having a pair of edge portions at least partially defining the exterior perimeter of said body; and
   (b) one or more longitudinally extending inserts surrounded on at least three sides by said body, the material of said inserts having greater impact resistance than the material of said body; and
   (c) a pair of latch members, each located between a point away from the mid-line of the body and the closest edge portion.

* * * * *